US007141347B2

(12) United States Patent
Kawase

(10) Patent No.: US 7,141,347 B2
(45) Date of Patent: Nov. 28, 2006

(54) PROCESS FOR MANUFACTURING A TONER

(75) Inventor: Yoshitaka Kawase, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 406 days.

(21) Appl. No.: 10/824,476

(22) Filed: Apr. 15, 2004

(65) Prior Publication Data

US 2004/0209182 A1 Oct. 21, 2004

(30) Foreign Application Priority Data

Apr. 21, 2003 (JP) ..... 2003-116057

(51) Int. Cl.
*G03G 5/00* (2006.01)

(52) U.S. Cl. ..... 430/137.14; 430/137.1; 430/137.16

(58) Field of Classification Search ..... 430/137.14, 430/137.1, 137.16
See application file for complete search history.

(56) References Cited

U.S. PATENT DOCUMENTS 5,607,807 A * 3/1997 Odell et al. ..... 430/137.19

FOREIGN PATENT DOCUMENTS

JP 05-066600 3/1993

* cited by examiner

*Primary Examiner*—Mark A. Chapman
(74) *Attorney, Agent, or Firm*—Nixon & Vanderhye, P.C.

(57) ABSTRACT

A toner manufacturing process capable of providing a toner with uniform charge amounts. A mixture of a synthetic resin having an acidic leaving group and a coloring agent as essential components is emulsified in an aqueous solution to produce synthetic resin particles containing the coloring agent. If desired, the resin particles are further aggregated to form aggregated resin particles. The synthetic resin particles are then separated, washed and dried. The washing of the toner particles is conducted using a washing water prepared by dissolving carbon dioxide in water with a conductivity of not more than 20 μS/cm.

3 Claims, No Drawings

PROCESS FOR MANUFACTURING A TONER

This Nonprovisional application claims priority under 35 U.S.C. § 119(a) on Patent Application No. 2003-116057 filed in Japan on Apr. 21, 2003, the entire contents of which are hereby incorporated by reference.

BACKGROUND OF THE INVENTION

1. Technical Field

The present invention relates to a process for manufacturing a toner for the development of electrostatic latent image during the image formation by an electrophotographic method, for example. More particularly, the invention relates to a process whereby a mixture containing at least a synthetic resin with an acidic leaving group and a coloring agent is rendered water-dispersible by neutralizing the acidic leaving group in the synthetic resin with amine or alkali. The mixture is then mixed, stirred, and emulsified in an aqueous solution to produce a synthetic resin particle containing the coloring agent. The synthetic resin particle is preferably further aggregated to produce an aggregated resin particle, which is then washed.

2. Background Art

Two kinds of electrostatic latent image developer are known. One is the two-component developer that contains a toner particle and a carrier particle, and the other is the one-component developer containing a magnetic toner particle or a non-magnetic toner particle. The process for manufacturing developer toner particles can be divided into a dry process and a wet process. The dry process includes a pulverizing method whereby a binding resin and a coloring agent, for example, are kneaded, pulverized and then classified. The wet process includes a polymerization method whereby a coloring agent or the like is added during the polymerization of a binding resin. The wet process also includes an emulsion polymerization condensation method whereby a resin dispersion liquid is prepared by emulsion polymerization. The resin dispersion liquid is then mixed with a coloring-agent dispersion liquid comprising a solvent in which a coloring agent or the like is dispersed. The resultant aggregated particle is then heated and fused, thereby obtaining a toner. Another example of the wet process, a phase-inversion emulsification method, is disclosed in JP Patent No. 3063269. In this method, a coloring agent is dispersed and mixed in a solution in which a resin having an acidic group is dissolved in an organic solvent, and then the acidic group of the resin is neutralized by a base, thereby preparing a coloring-agent mixture. Water is added to emulsify the mixture, such that an encapsulated particle is produced in the water medium, which is then dried to obtain a toner.

If the wet process involves the step of producing a toner particle in an aqueous solution, impurities, such as a dispersing agent, emulsifier or flocculating agent, are used for the granulation of toner. As a result, the charging characteristics of the obtained toner has variations such that the amount of charge greatly differs depending on the environment in which the toner is used. It would also take time to remove these impurities by washing, which would require a large volume of water for washing.

SUMMARY OF THE INVENTION

In an example of the wet process for manufacturing a toner, a mixture containing, as principal components, a synthetic resin and a coloring agent is stirred, the resin containing an acidic leaving group and being capable of being rendered water-dispersible by neutralization. The acidic leaving group of the synthetic resin is neutralized with a basic neutralizing agent and then the mixture is emulsified in an aqueous solution, thereby producing a synthetic resin particle containing the coloring agent. If desired, a flocculating agent is further added to produce an aggregated resin particle, which is then separated. The neutralized acidic leaving group on the surface of the particle is then turned back into the original functional group by an acid in a reverse-neutralizing process. The particle is then washed and dried. In this process, ionic compounds such as the basic neutralizing agent, flocculating agent and acid are added, so that a great volume of water would be required for the subsequent washing process. When the resin particle is seen as a toner, these impurities function as a source of adsorption of water and therefore they can be the cause of charge instability upon change of environment.

Thus, it is preferable to employ a resin particle production process that employs ionic compounds such as those mentioned above that are easily removable by washing, or a process in which the addition of these ionic compounds is minimized.

In view of the aforementioned problems of the prior art, it is the object of the invention to provide a process for manufacturing a toner whereby a mixture containing, as principal components, a synthetic resin with an acidic leaving group and a coloring agent is emulsified in an aqueous solution, thereby producing a synthetic resin containing the coloring agent. If desired, the resin particle is further aggregated to produce an aggregated resin particle, which is then separated, washed and dried. The ionic compounds used for emulsification and flocculation are efficiently removed.

The aforementioned object of the invention is achieved by washing the synthetic resin particle with specific washing water.

Specifically, the invention provides a process for manufacturing a toner, comprising:

emulsifying a mixture of a synthetic resin having an acidic leaving group and a coloring agent as essential components in an aqueous solution to thereby form synthetic resin particles containing the coloring agent;

forming, if desired, aggregated resin particles by coagulating the formed resin particles; and separating, washing and then drying the synthetic resin particles, the process further comprising washing the toner particles with a washing water prepared by dissolving carbon dioxide in water with a conductivity of not more than 20 μS/cm.

Preferably, the synthetic resin having the acidic leaving group comprises a polyester resin.

Preferably, the acidic leaving group of the synthetic resin comprises a carboxyl group.

When a mixture of a synthetic resin having an acidic leaving group such as a carboxyl group and a coloring agent as essential components is processed with aqueous ammonia as a neutralizing agent for the acidic leaving group for emulsification, and the processed mixture is then emulsified in an aqueous solution in order to form synthetic resin particles containing the coloring agent, and, if desired, the thus formed resin particles are aggregated to form aggregated resin particles in order to prepare toner particles, it is preferable to reverse-neutralize the neutralized acidic leaving group into the original acidic leaving group using an acid, in light of charge stability. It is also necessary to wash and remove the neutralizing agent, i.e., ammonia, that is contained excessively, using water. If the acid and water are provided in the form of water in which carbon dioxide is dissolved, the water is weakly acidic and is therefore capable of rendering the acidic leaving group that exists in the form of an ammonium salt or metal salt back into the original acidic leaving group. Further, the water can be subjected to degasification, for example, to eliminate any excess carbon dioxide, thus rendering the water back into pure water without any impurities. Thus, a toner with uniform charge amounts can be manufactured.

The water for washing the toner particles, in which carbon dioxide is dissolved, is weakly acidic and is therefore impervious to the growth of bacteria. Further, the water after washing can be circulated and reused, so that the number of times the washing water must be changed can be reduced and the total volume of water can be reduced.

While the above description concerns the ultimate combination in which the emulsifier (neutralizing agent) comprises aqueous ammonia, which can be subjected to degasification, other basic neutralizers or flocculating agents may be used and still the effect of washing with carbon dioxide-dissolved water is better than the effect of washing only with water after the neutralized acidic leaving group is reverse-neutralized with an acid such as hydrochloric acid, and the volume of washing water can be reduced.

Further, in the present invention, by employing, as the synthetic resin having an acidic leaving group, a resin including at least a polyester resin, a toner can be easily obtained in which powder fluidity and fixing property are well balanced. Thus, the invention provides a toner that can be used for color toners, and a process for manufacturing a toner involving no intrusion of polymerization initiator or unreacted monomers, in which the washing step is relatively simple.

In accordance with the toner manufacturing process of the present invention, the synthetic resin contains a carboxyl group, so that the synthetic resin can be easily neutralized and a high level of hydrophilicity to the resin can be obtained. Thus, the mixture of the resin and a coloring agent or the like can be easily emulsified. The carboxyl group can be easily reverse-neutralized into the original functional group, so that the intrusion of ionic impurities can be minimized.

DETAILED DESCRIPTION OF THE PREFERRED EMBODIMENTS

For emulsifying a mixture containing, as principal components, a synthetic resin having an acidic leaving group and a coloring agent in an aqueous solution to thereby produce a synthetic resin particle containing the coloring agent, and, optionally, further aggregating the thus produced resin particle to produce a aggregated resin particle, one of the following methods is employed: (1) a method comprising the steps of heating and fusing the mixture, and emulsifying the resultant mixture in an aqueous solution as is or after dissolving or dispersing in an organic solvent, thereby producing a synthetic resin particle containing the coloring agent; and (2) a method comprising the steps of dissolving a synthetic resin in a dissolvable organic solvent to produce a mixture, and emulsifying the resultant mixture in an aqueous solution to thereby produce a synthetic resin particle containing the coloring agent. Any known organic solvent can be used as the organic solvent for the invention. Any single kind of solvent may be used, or two or more kinds of solvent may be used.

In cases where a fused material of a solid portion consisting mainly of a synthetic resin is neutralized and emulsified in an aqueous solution using a neutralizing agent, without using an organic solvent, this is not the case.

The organic solvent for dissolving the resin should be selected from the viewpoints of ease of emulsification, the form (state) of the obtained particle, and the distribution of particle size. Preferably, a mixture of the organic solvent and a surface-tension reducing organic solvent that has a higher hydrophilicity than the solvent may be used.

Any type of organic solvent may be used as long as it is capable of dissolving synthetic resin. Preferably, it is appropriate to use a "low-boiling point" solvent that easily renders itself to dissolution, such as methyl ethyl ketone or ethyl acetate. Other preferable examples include water-soluble or highly hydrophilic organic solvent with a surface-tension reducing property, such as acetone, butanol, isopropyl alcohol, hexanediol, tetrahydrofuran, dimethylformamide and butylcellulose. Two or more kinds of solvents may be mixed.

The synthetic resin used in the present invention as a binding resin includes those synthetic resins that can be neutralized into self-water dispersible resins. The self-water dispersible resins are resins that have an acidic or basic, hydrophilic leaving group in their molecular chains. They can be neutralized with a basic neutralizer if the leaving group is acidic, or with an acidic neutralizer if the leaving group is basic. By so doing, a salt is formed by the leaving group and their hydrophilicity is improved, so that they can acquire the self-water dispersible property.

The improvement of hydrophilicity by neutralization must be to such an extent that the resin itself can be dispersed in water. The thus obtained self-water dispersible resin is then mixed with an aqueous solution so that emulsification takes place and particles can be produced in the aqueous solution.

For example, a self-water dispersible polyester resin exposes a hydrophilic leaving group onto the surface of the resin particle in an aqueous solution such that the hydrophobic portion of the particle is covered with the leaving group, thereby stabilizing the particle.

The effect of such hydrophilic leaving group is the same whether the leaving group in the resin is neutralized with a neutralizing agent or the resin has a salt structure that has been neutralized from the beginning.

In the case of the present invention in which the synthetic resin has an acidic leaving group, the neutralizing agent may be ammonia, sodium hydroxide, potassium hydroxide or triethylamine, for example. Using such neutralizing agent, an appropriate amount of the hydrophilic leaving group in the resin is neutralized.

The hydrophilicity of the self-water dispersible resin can be adjusted by the amount of the hydrophilic leaving group in the resin and the ratio of neutralization of the hydrophilic leaving group, whereby the size of the particle that is dispersed is determined.

While the amount of hydrophilic acidic leaving group contained in the resin is not particularly limited, the amount is preferably 10 to 1,000 mg equivalent weight per 100 g of a solid resin.

Further, the amount of the acidic leaving group that is neutralized for the synthetic resin to exhibit the self-water dispersible property varies depending on the particular resin used, as the hydrophilicity of the resin varies depending on the molecular structure or molecular weight of the resin. Normally, however, the amount is 1 to 500 mg equivalent weight per 100 g of the solid resin.

Preferably, the glass transition temperature of the self-water dispersible resin should be 30 to 100° C. The weight-average molecular weight of the resin should be preferably 5,000 to 500,000.

The toner particle according to the invention may employ a known coloring agent such as those conventionally used as toner materials, and is not particularly limited. Examples include the following organic or inorganic dyes or pigments.

Namely, examples of black coloring agents include carbon black, copper oxide, manganese dioxide, aniline black, activated carbon, nonmagnetic ferrite, magnetic ferrite, and magnetite.

Examples of yellow coloring agents include compounds of chrome yellow, zinc yellow, cadmium yellow, iron oxide yellow, mineral fast yellow, nickel titanium yellow, navel yellow, naphthol yellow S, hansa yellow G, hansa yellow 10G, benzidine yellow G, benzidine yellow GR, quinoline yellow lake, permanent yellow NCG, tartrazine lake, CI pigment yellow 12, CI pigment yellow 13, CI pigment yellow 14, CI pigment yellow 15, CI pigment yellow 17, CI pigment yellow 93, CI pigment yellow 94, and CI pigment yellow 138.

Examples of orange coloring agents include compounds of red chrome yellow, molybdate orange, permanent orange GTR, pyrazolone orange, balkan orange, indanthrene brilliant orange RK, benzene orange G, indanthrene brilliant orange GK, CI pigment orange 31, and CI pigment orange 43.

Examples of red coloring agents include compounds of colcothar, cadmium red, red lead, mercury sulfide, cadmium, permanent red 4R, lithol red, pyrazolone red, watching red, calcium salt, lake red C, lake red D, brilliant carmine 6B, eosin lake, rhodamine lake B, alizarin lake, brilliant carmine 3B, CI pigment red 2, CI pigment red 3, CI pigment red 5, CI pigment red 6, CI pigment red 7, CI pigment red 15, CI pigment red 16, CI pigment red 48:1, CI pigment red 53:1, CI pigment red 57:1, CI pigment red 122, CI pigment red 123, CI pigment red 139, CI pigment red 144, CI pigment red 149, CI pigment red 166, CI pigment red 177, CI pigment red 178, and CI pigment red 222.

Examples of violet coloring agents include compounds of manganese violet, fast violet B, and methyl violet lake.

Examples of blue coloring agents include compounds of iron blue, cobalt blue, alkaline blue lake, Victoria blue lake, phthalocyanine blue, metal-free phthalocyanine blue, phthalocyanine blue partial chlorine compound, fast sky blue, indanthrene blue BC, CI pigment blue 15, CI pigment blue 15:2, CI pigment blue 15:3, CI pigment blue 16, and CI pigment blue 60.

Examples of green coloring agents include compounds of chrome green, chromium oxide, pigment green B, mica light green lake, final yellow green G, CI pigment green 7.

Examples of white coloring agents include compounds of zinc white, titanium oxide, antimony white, and zinc sulfide.

Preferable examples of the binding resin made of a synthetic resin having an acidic leaving group include polyester resin, polyurethane resin, epoxy resin, and styrene-acrylic resin. Of these, polyester resin is particularly suitable, as using polyester makes it is relatively easy to strike a balance among various properties of the toner, such as powder fluidity and fixing property. Alternatively, a polyester resin and a styrene-acrylic copolymer may be grafted to take advantage of both. With polyester resin, it is possible to attain a low-temperature fixing by taking advantage of the sharp-melt property of the resin, and superior transparency and secondary-color reproducibility can be obtained. Thus, polyester resin is also suitable as a color toner.

Hereafter, polyester resins will be described as an example of the synthetic resin having an acidic leaving group.

In the present invention, synthetic polyester resin that can be neutralized to become self-water dispersible, for example, can be used. Such polyester resin can form stable particles in an aqueous solution by the action of the leaving group existing in the resin molecules whose hydrophilicity can be increased by neutralization, virtually without using any emulsifier or dispersion stabilizer.

A self-water dispersible polyester, which can be rendered into a self-water dispersible resin by neutralization, can be synthesized and used by conventional synthesizing methods. For example, a polyester resin having a carboxyl group as the hydrophilic group, which can be rendered into a self-water dispersible resin, can be synthesized by conventional polycondensation reaction.

Specifically, a polybasic acid and a polyhydric alcohol are dehydrated and condensed in the presence of a catalyst and in the presence or absence of a solvent. Part of the polybasic acid may be subjected to demethanol polycondensation using the methyl ester compound.

Examples of usable polybasic acids include: aromatic carboxylic acids such as terephthalic acid, isophthalic acid, phthalic anhydride, trimellitic anhydride, pyromellitic acid and naphthalene dicarboxylic acid; and aliphatic carboxylic acids such as maleic anhydride, fumaric acid, succinic acid, alkenyl succinic anhydride and adipic acid.

Examples of usable polyhydric alcohols include: aliphatic polyhydric alcohols such as ethylene glycol, propylene glycol, butanediol, hexanediol, neopentyl glycol and glycerin; alicylic polyhydric alcohols such as cyclohexane diol, cyclohexane dimethanol and hydrogenated bisphenol A; and aromatic diols such as ethylene oxide adduct of bisphenol A and propylene oxide adduct of bisphenol A.

The content of the terminal carboxyl group, for example, can be controlled by the mixture ratio and reaction ratio of the polybasic acid and polyhydric alcohol, which are the materials for polyester. Alternatively, the carboxyl group can also be easily introduced into the main chain by using trimellitic anhydride.

The polycondensation reaction is terminated when the acid number and the softening point reach predetermined values, whereupon a target polyester resin that can be rendered self-water dispersible can be obtained.

While polyester resins have been described above, other resins, such as urethane resins, epoxy resins, and acrylic resins may also be used.

When the resin is a urethane resin, a urethane resin having an acidic group can be obtained by conventional methods, such as by causing a diol containing an acidic or basic group, such as dimethylol propionic acid or N-methyldiethanolamine, to undergo, as part of various polyol components such as polyeter glycol such as polyethylene glycol, polyester polyol, acrylic polyol and polybutadiene polyol, addition polymerization with polyisocyanates such as tolylenediisocyanate, hexamethylene diisocyanate, isophorone diisocyanate.

When the resin is an epoxy resin, an epoxy resin containing an acidic group can be obtained by causing the epoxy resin as a base to undergo: addition or addition polymerization with a polyvalent carboxylic acid such as adipic acid or trimellitic dehydrate; or addition or addition polymerization with dibutyl amine or ethylene diamine.

When the resin is an acrylic resin, an acrylic polymerizable monomer containing an acidic group and another polymerizable monomer different from the polymerizable monomer containing the aforementioned hydrophilic group may be subjected to radical polymerization in the presence of a radical initiator to obtain an acrylic resin. The polymerization reaction may be either solution polymerization, suspension or emulsion polymerization.

The synthetic resin used may be a single resin or a mixture of a plurality of resins with different molecular weights or monomer compositions.

In the present invention, the emulsion machine used for emulsification is not particularly limited and may be any commercially available emulsion machine or distribution machine. Examples include, but are not limited to, batch-type emulsion machines such as Ultra-Turrax (IKA-Works), Polytron homogenizer (Kinematica), TK Autohomomixer (Tokushu Kika Kogyo Co., Ltd.), and National Cooking Mixer (Matsushita Electric Industrial Co., Ltd.); continuous-type emulsion machines such as Ebara Milder (Ebara Corporation), TK Pipeline Homomixer, TK Homomic Line Flow, and Filmics (Tokushu Kika Kogyo Co., Ltd.), Colloid Mill (Shinko Pantec Co., Ltd.), Slusher and Trigonal Wet Grinder (Mitsui Miike Kakoki Co., Ltd.), Cavitron (Eurotek Inc.), Fine Flow Mill (Taiheiyo Kiko Co., Ltd.); and batch and continuous emulsion machines such as Cleamix (M Technique Co., Ltd.) and Filmics (Tokushu Kika Kogyo Co., Ltd.).

In the present invention, when a solid fused material consisting mainly of a synthetic resin is formed and then emulsified by neutralization in an aqueous solution, the fused materials are dry-mixed in a mixer, heat-fused, and kneaded, and then distributed and finely dispersed.

Examples of the blending machine include, but are not limited to: Henschel-type mixers such as Henschel Mixer (Mitsui Kozan K. K.), Super Mixer (Kawada Mfg. K. K.), and MECHANOMiLL (Okada Seiko Co., Ltd.); Ong Mill (Hosokawamicron Corporation), Hybridization System (Nara Machinery Co., Ltd.); and Cosmosystem (Kawasaki Heavy Industries, Ltd.).

As the kneader, a double-axle extruding machine, a three roll, a laboratory blast mill, or other conventional kneaders may be used. Specific examples include, but are not limited to, single- or double-axle extruders such as TEM-100B (Toshiba Machine Co., Ltd.), PCM-65/87 (Ikegai, Ltd.), and open-roll type machines such as Kneadex (Mitsui Kozan K. K.).

Other constituent components (additive agents) that can be used in the present invention include various auxiliary agents such as charge control agents and mold-releasing agents, which can be properly selected depending on the purpose and condition of use. The obtained toner may be provided with an external additive such as silica or titanium oxide, or with various types of surface modification.

To produce a synthetic resin particle containing a coloring agent in the emulsification step, an emulsifier or a dispersion stabilizer may be used, as necessary.

Examples of the emulsifier include, but are not limited to, anionic surfactants such as sodium lauryl sulfate, dodecyl diphenyl oxide sodium disulphonate, and sodium dodecylbenzenesulfonate, and nonionic surfactants such as polyoxyethylene lauryl ether, and polyoxyethylene nonyl phenol ether.

As the dispersion stabilizer, water-soluble polymer compounds or water-insoluble inorganic compounds may be used. Examples of water-soluble polymer compounds include, but are not limited to, such as polyvinyl alcohol, polyvinylpyrrolidone, hydroxyethyl cellulose, carboxymethyl cellulose, and cellulose gum. Examples of water-insoluble inorganic compounds include, but are not limited to: water-insoluble salts such as calcium phosphate, barium sulfate, calcium sulfate, barium carbonate, calcium carbonate, and magnesium carbonate; inorganic polymer compounds such as talc and silicic acid, metal oxides such as aluminum oxide and titanium oxide; and metal hydroxides such as aluminum hydroxide and ferric hydroxide.

In order to promote flocculation during the production of aggregated resin particles by aggregating the resin particles, a water-soluble metal compound may preferably be used. The water-soluble metal compound may be any conventional compound such as, for example, metal halides with a valence of two or more. Specific examples include, but are not limited to: metal salts such as calcium chloride, calcium nitrate, barium chloride, magnesium chloride, zinc chloride, aluminum chloride; and aluminum sulfate, and inorganic metal salt polymers such as poly aluminum chloride, poly aluminum hydroxide, and calcium polysulfide. In the present invention, a synthetic resin having an acidic leaving group is used in order to provide a negatively charged toner. Examples of the acidic leaving group include any carboxyl group, sulfonic acid group, and phosphate group. Of these, a carboxyl group is preferable as an acidic group. When a method is employed in the emulsification step whereby particles are obtained by neutralizing the acidic leaving group of the synthetic resin with a base such as amine or alkali, thereby making the synthetic resin water-dispersible, the resultant particles exist in the form of ammonium salt or metal salt. When the particles are seen as toner, these salts function as a source of water absorption and therefore reduces the charge stability of the toner upon change of environment. Accordingly, while it is preferable to render the leaving group back into the original acidic leaving group, doing so would require the addition of an acid (such as hydrochloric acid, nitric acid or acetic acid). This would be, in a sense, equivalent to the addition of an impurity, which would require a great volume of water for the subsequent washing step.

In the present invention, water in which carbon dioxide is dissolved is used as the washing water. The washing water also functions as an acid, so that the addition of extra acid can be reduced or minimized. Compared other acidic leaving groups, the carboxyl group exhibits weak acidity, and, therefore, the addition or detachment of H+ starts in a weak acid region. When the water containing carbon dioxide is seen as a reverse-neutralization acid, it has the effect of rendering the carboxyl group, in the form of ammonium salt or metal salt, back into the original carboxyl group.

When the water in which carbon dioxide is dissolved is allowed to stand, the carbon dioxide diffuses out and the water is turned into normal water. Thus, there is no need to pay particular attention to the disposal of fluid wastes, which contributes to reduction in cost and protection of the environment.

When the carbon dioxide-dissolved water is used instead of water as the washing water, the water after the washing of particles can be circulated and reused and still the growth of bacteria can be prevented. Thus, the number of times the washing water must be replaced can be reduced and therefore the total volume of water used can be reduced.

For obtaining water with a conductivity of not more than 20 μS/cm that is used in the invention, an activated carbon method, ion exchange method, distillation method, or reverse osmosis method may be used, for example. Any one of these methods may be selected or any number of them may be combined, for example. The amount of carbon dioxide in the carbon dioxide-dissolved water may be any level up to saturation. However, if the amount is too little, it would be impossible to maintain a low pH level, so that the effect of the present invention would not be fully provided. While it is practical to control the amount of dissolution of carbon dioxide by either monitoring the pH or conductivity of the water, it is preferable to monitor pH, as the process involves the reverse-neutralization of the acidic leaving group on the particle surface that has been neutralized. When expressed in pH value, the dissociation constant of $H_2CO_3$ at 25° C. is:

$$[H^+][HCO_3^-]/[H_2CO_3]=1.3\times10^{-4}$$

Thus, the carbon dioxide-dissolved water should be prepared to have a pH between 3.8 and 7.0.

Carbon dioxide can be dissolved in water by a bubbling method or a method involving the use of a diaphragm. What is important in the present invention is that water in which carbon dioxide is dissolved is used, and the manner in which such water is prepared is not particularly limited. It should be noted, however, that water in which carbonate such as sodium carbonate is dissolved is not suitable because it contains cations as impurities, which would function as a source of water absorption from the viewpoint of toner, and therefore it lacks in charge stability upon change of environment.

In the step of washing the toner particles with the water in which carbon dioxide is dissolved in water with a conductivity of not more than 20 μS/cm, the washing bath may be either batch-type or continuous-type. The temperature of the washing solution is not particularly limited as long as a stable amount of carbon dioxide can be dissolved in the water. It is preferable, however, to wash at temperatures of not less than 10° C. and not more than 80° C. It is also preferable to perform washing until the supernatant of the particle washing solution has a conductivity of 50 μS/cm or less, as this would reduce the difference in toner charge amounts depending on the degree of washing.

Hereafter, the manufacturing method of the invention will be described with reference to a synthetic resin having an acidic leaving group such that a self-water dispersible property can be imparted to the resin by a neutralization with a base.

In a first step, a self-water dispersible resin is obtained by neutralizing a resin that can be rendered self-water dispersible by neutralization with a base. The resin is then uniformly mixed with an organic solvent that dissolves the resin, a coloring agent, and other additives, if necessary, such as a charge control agent, a mold-releasing agent and a dispersing agent, thereby obtaining a mixture.

The addition of coloring agent and so on is performed by a known dispersing means, such as a dispersing machine.

When the mixture is obtained using an organic solvent, the resin and the organic solvent are mixed, and then a charge control agent, coloring agent and so on are dispersed in the mixture using a dispersing machine, for example.

When the mixture is obtained by fusing and kneading without using an organic solvent, the mixture is prepared by uniformly mixing the coloring agent and other additives, if necessary, such as charge control agent, mold-releasing agent and dispersing agent, using a mixer or a kneader.

The resultant mixture may be dissolved using an organic solvent that dissolves the resin, or be emulsified in an aqueous solution without using an organic solvent.

A necessary amount of the resin is neutralized using a neutralizing agent before it is mixed with water in the next step. If the acidic leaving group of the resin is already neutralized and the resin already has the self-water dispersible property, this neutralizing step is not necessary.

In a second step, the mixture obtained in the preceding step is emulsified to produce particles of the self-water dispersible resin containing the coloring agent and so on. The liquid temperature during emulsification should preferably be set at approximately 10 to 40° C. However, as the particle size varies depending on the liquid temperature, the temperature must be maintained at a certain level. This is however not the case if the mixture has been obtained by fusing and kneading without the use of organic solvent, and if the mixture is emulsified in an aqueous solution. Preferably, the water used should be ion-exchange water or distilled water. If necessary, a neutralizing agent (emulsifier) or a dispersion stabilizing agent may be added to the water during emulsification.

In a third step, the particles are recovered from the water in which the produced particles are dispersed following the emulsification. In this step, a dissolution process is performed to remove any organic solvent that has been used from the toner and water. Then, as the acidic leaving group of the self-water dispersible resin forming the toner is neutralized, the toner particles are washed with the carbon dioxide-dissolved water of the invention, in which carbon dioxide is dissolved in water with a conductivity of not more than 20 μS/cm, thereby rendering the acidic leaving group back into its original state and removing impurities. If this process is not performed, the toner particles would be more likely be affected by the water in air and the toner charge characteristics would be defective. Finally, impurities in the particles that would influence the toner charge characteristics are checked using a conductivity meter or the like, and then the particles are dried to obtain a powdered toner. Any known drying method may be used for this purpose, such as a freeze dry method or an airflow drying method, for example.

It is possible to add various additives such as silica or titanium oxide to the obtained toner, or provide various surface modification. These processes are optional and one or both of them may be selected as necessary.

EXAMPLES

The invention will be understood more readily with reference to the following example; however, these examples are intended to illustrate the invention and are not to be construed to limit the scope of the invention.

Evaluation of the toner in the following examples and comparable examples was conducted as follows.

The washing water with a conductivity of 0.5 μS/cm was prepared from tap water using Ultra Pure Water System CPW-102 (manufactured by ADVANTEC). Carbon dioxide supplied from a carbon dioxide gas cylinder was dissolved in this water by a bubbling method. The dissolved amount was controlled by monitoring the pH of the water. The temperature of the water was adjusted to 25° C. The pH and conductivity of the water were measured by LACOM Tester EC-PHCON10 (manufactured by luchi Seieido). For washing, the sample and the water in which carbon dioxide was dissolved were put in a polyvinylchloride container such that 10% by weight of a solid matter remained therein. The sample and the water were then stirred by a turbine-shaped stirring blade at 300 rpm for 30 min, thus washing the sample. The thus washed sample was then separated by centrifugation into a supernatant and a solid matter, the latter of which was then dispersed in water and dried by a freeze dry method.

The particle size of the obtained toner and the distribution of particle sizes were measured by a Coulter Multisizer (manufactured by Coulter).

Potentiometric titration of the gram equivalent of the acidic leaving group of the synthetic resin was performed as follows.

One gram of the resin was dissolved with tetrahydrofuran and was then titrated with a commercially available N/10 potassium hydroxide-ethanol solution (manufactured by Kishida Chemical Co., Ltd.). The gram equivalent of the acidic leaving group contained in the resin was determined on the basis of the amount of the N/10 potassium hydroxide-ethanol solution that was required for neutralization.

For each of the following examples and comparative examples, 3 parts by weight of the obtained toner was mixed and stirred with 97 parts by weight of a ferrite carrier having a volume average particle size of 60 μm, thereby preparing a two-component developer. The environmental stability of the charge characteristics of the developer was then determined. The charge amounts between normal and high temperature/humidity environments were compared by conducting a charge-amount measurement by a blow-off method under a normal temperature/humidity environment condition of 20° C. and 50% RH and a high temperature/humidity condition of 35° C. and 80% RH. The various kinds of washing water used in the examples and comparative examples were all obtained from the same water source.

Example 1

One-hundred and eighty parts by weight of methyl ethyl ketone was added to 170 parts by weight of polyester resin (acid value: 14 mgKOH/g) having 0.250 mmol/g of acidic leaving group. After the methyl ethyl ketone was well dissolved, 20 parts by weight of carbon black and 10 parts by weight of wax were added. The mixture was then put into Filmics 56 (manufactured by Tokushu Kika Kogyo, Co., Ltd.) and dispersed at 40 m/s for 5 minutes. After the end of dispersion, methyl ethyl ketone was used to adjust the solid matter content to 50%, thereby obtaining a resin-solution mixture. Fifty parts by weight of 1 N aqueous ammonia was added to 200 parts by weight of the resin-solution mixture. The rotation speed of the homogenizer was set at 3,000 RPM, and 100 parts by weight of deionized water was added dropwise to emulsify the mixture and produce particles. Then, methyl ethyl ketone was removed by vacuum distillation, and the particles were washed with 10 L of water with a pH of 4.0 in which carbon dioxide had been dissolved. The solid matter was recovered by centrifugation, dried and then mixed with hydrophobic silica, thereby obtaining toner particles with a volume average particle diameter of 7.0 μm and a circularity of 0.97.

Example 2

The washing was conducted with water with a pH of 4.0 in which carbon dioxide was dissolved, and when the conductivity of the supernatant became 30 μS/cm, the solid matter was recovered by centrifugation and then dried. Hydrophobic silica was then added and mixed therein, thereby obtaining toner particles with a volume average particle size of 7.0 μm and a circularity of 0.97.

Example 3

Toner particles with a volume average particle size of 7.0 μm and a circularity of 0.97 were obtained in the same manner as in Example 1, except that the washing water had a conductivity of 20 μS/cm and was filtered with activated carbon and processed with ion-exchange resin.

Example 4

Toner particles with a volume average particle size of 7.0 μm and a circularity of 0.97 were obtained in the same manner as in Example 1, except that the washing was performed first with 5 L of water with a pH of 4.0 in which carbon dioxide was dissolved, and then with 5 L of water with a conductivity of 0.5 μS/cm.

Example 5

One-hundred and eighty parts by weight of methyl ethyl ketone were added to 170 parts by weight of polyester resin (acid value: 14 mgKOH/g) having 0.250 mmol/g of an acidic leaving group. After dissolving well, 20 parts by weight of carbon black and 10 parts by weight of wax were added. The mixture was then put into Filmics 56 (manufactured by Tokushu Kika Kogyo, Co., Ltd.). After dispersing at 40 m/s for 5 minutes, the solid matter content was adjusted to be 50% using methyl ethyl ketone, thereby obtaining a resin-solution mixture. Fifty parts by weight of 1 N aqueous ammonia and 0.15 part by weight of calcium chloride dehydrate were added to 200 parts by weight of the resin-solution mixture. With the rotation speed of a homogenizer set at 10,000 RPM, 100 parts by weight of water was added dropwise, thereby emulsifying the mixture and forming particles. Stirring of the resultant particle-dispersed liquid was continued under the same condition, and 10 minutes after the addition of water, the speed of stirring was reduced to 3,000 RPM. Thereafter, 200 parts of dilution water and 4 parts of 1 N aqueous ammonia were added, thereby coagulating the particles.

Then, methyl ethyl ketone was removed by vacuum distillation, and the particles were washed with 10 L of water with a pH of 4.0 in which carbon dioxide was dissolved. The solid matter was recovered by centrifugation and then dried, to which hydrophobic silica was added and mixed, thereby obtaining toner particles with a volume average particle size of 7.2 μm and a circularity of 0.97.

Example 6

One-hundred and seventy parts by weight of polyester resin having 0.250 mmol/g of an acidic leaving group, 20 parts by weight of carbon black, and 10 parts by weight of wax were put into a Henschel mixer and mixed for 10 minutes. The materials were then fused, kneaded and dispersed at temperatures not more than 120° C., using Kneadex MOS140-800 manufactured by Mitsui Kozan K. K., thereby obtaining a resin mixture. Two-hundred and ten parts by weight of methyl ethyl ketone was then added to 210 parts by weight of the resin mixture and was dissolved well, thereby obtaining a resin-solution mixture with a solid matter content of 50%.

Fifty parts by weight of 1N aqueous ammonia was then added to 200 parts by weight of the resin-solution mixture. Rotation speed of the homogenizer was set at 3000 RPM, and 100 parts by weight of deionized water was added dropwise, thereby emulsifying the mixture and forming particles. Methyl ethyl ketone was then removed by vacuum distillation, and the particles were washed with 10 L of water with a pH of 4.0 in which carbon dioxide was dissolved. The solid matter was recovered by centrifugation and then dried, to which hydrophobic silica was then added and mixed therein. Thus, toner particles with a volume average particle size of 6.8 μm and a circularity of 0.97 were obtained.

Example 7

Toner particles with a volume average particle size of 6.8 μm and a circularity of 0.97 were obtained in the same manner as in Example 6, except that the washing water was filtered by activated carbon and processed by ion-exchange resin and had a conductivity of 20 μS/cm.

Comparative Example 1

Toner particles with a volume average particle size of 7.0 μm and a circularity of 0.97 were obtained in the same manner as in Example 1, except that the solid matter was recovered by centrifugation after the washing was performed using water with a pH of 4.0 in which carbon dioxide was dissolved, until the conductivity of the supernatant became 100 μS/cm.

Comparative Example 2

Toner particles with a volume average particle size of 7.0 μm and a circularity of 0.97 were obtained in the same manner as in Example 1, except that the washing water, which came from the same water source, was not subjected to any purification process and had a conductivity of 100 μS/cm.

Comparative Example 4

Toner particles with a volume average particle size of 7.0 μm and a circularity of 0.97 were obtained in the same manner as in Example 1, except that the washing was performed using 10 L of water with a conductivity of 0.5 μS/cm after the ammonia on the surface of the particles was neutralized and removed by adjusting pH at 4.0 by using dilute hydrochloric acid in the washing step.

Comparative Example 5

Toner particles with a volume average particle size of 7.0 μm and a circularity of 0.97 were obtained in the same manner as in Example 1, except that the washing was performed using 10 L of water with a conductivity of 0.5 μS/cm after the ammonia on the surface of the particles was neutralized and removed by adjusting pH at 2.0 by using dilute hydrochloric acid in the washing step.

Comparative Example 6

Toner particles with a volume average particle size of 7.0 μm and a circularity of 0.97 were obtained in the same manner as in Example 1, except that the washing was performed using 10 L of water with a conductivity of 0.5 μS/cm in which no carbon dioxide was dissolved.

| Sample | Avg. particle size (μm) | Conductivity of water used (μS/cm) | pH of water used | Conductivity of supernatant after washing (μS/cm) | Normal/high temperature-humidity charge amount ratio | Implemented or compared item |
|---|---|---|---|---|---|---|
| Ex. 1 | 7.0 | 0.5 | 4.0 | 10 | 1.20 | Washed with carbon dioxide-dissolved water |
| Ex. 2 | 7.0 | 0.5 | 4.0 | 30 | 1.26 | Difference in conductivity of supernatant after washing |
| Ex. 3 | 7.0 | 20.0 | 4.0 | 30 | 1.27 | Difference in conductivity of washing water |
| Ex. 4 | 7.0 | 0.5 | 4.0 | 10 | 1.27 | Combination of carbon dioxide-dissolved water and water |
| Ex. 5 | 7.2 | 0.5 | 4.0 | 10 | 1.26 | Difference in method of forming particles |
| Ex. 6 | 6.8 | 0.5 | 4.0 | 10 | 1.23 | |
| Ex. 7 | 6.8 | 20.0 | 4.0 | 30 | 1.27 | |
| Comp. Ex. 1 | 7.0 | 0.5 | 4.0 | 100 | 1.69 | Difference in conductivity of supernatant after wash |
| Comp. Ex. 2 | 7.0 | 100 | 4.0 | 110 | 1.71 | Difference in conductivity of wash water |
| Comp. Ex. 3 | 7.0 | 25 | 4.0 | 50 | 1.38 | Difference in conductivity of wash water |
| Comp. Ex. 4 | 7.0 | 0.5 | 4.0 | 10 | 1.26 | Washed with dilute hydrochloric acid + water instead of with carbon dioxide-dissolved water |
| Comp. Ex. 5 | 7.0 | 0.5 | 2.0 | 10 | 1.26 | |
| Comp. Ex. 6 | 7.0 | 0.5 | 6.0 | 10 | 1.84 | Washed only with water; neither carbon dioxide-dissolved water nor dilute hydrochloric acid used |

Comparative Example 3

Toner particles with a volume average particle size of 7.0 μm and a circularity of 0.97 were obtained in the same manner as in Example 1, except that the washing water was filtered by activated coal and processed by ion-exchange resin and had a conductivity of 25 μS/cm.

In accordance with the inventive process for manufacturing a toner, the washing water is weakly acidic because it has carbon dioxide dissolved therein. Thus, the washing water is capable of rendering the acidic leaving group that exists in the form of ammonium salt or metal salt back into the original acidic leaving group. Using the method of the invention, impurities such as neutralizing agent that were used for forming resin particles can be more efficiently removed than with the washing method that washes solely with water, and a toner with uniform charge levels can be manufactured.

Further, as the invention employs water in which carbon dioxide is dissolved (such that it is weakly acidic) as the toner particle washing water, the water that has been used for washing can be circulated and reused without the growth of bacteria or the like. Thus, the number of times the washing water must be changed can be reduced, and the total volume of water used can be reduced.

What is claimed is:

1. A process for manufacturing a toner, comprising:

emulsifying a mixture of a synthetic resin having an acidic leaving group and a coloring agent as essential components in an aqueous solution to thereby form synthetic resin particles containing the coloring agent;

forming, if desired, aggregated resin particles by coagulating the formed resin particles; and separating, washing and then drying the synthetic resin particles, the process further comprising washing the toner particles with a washing water prepared by dissolving carbon dioxide in water with a conductivity of not more than 20 μS/cm.

2. The process for manufacturing a toner according to claim 1, wherein the synthetic resin having the acidic leaving group comprises a polyester resin.

3. The process for manufacturing a toner according to claim 1, wherein the acidic leaving group of the synthetic resin comprises a carboxyl group.

* * * * *